United States Patent [19]

Schulz

[11] 4,341,042

[45] Jul. 27, 1982

[54] SLIDING DOOR SPACER

[75] Inventor: Donald A. Schulz, Wauwatosa, Wis.

[73] Assignee: S-B Manufacturing Co., Ltd., Milwaukee, Wis.

[21] Appl. No.: 182,721

[22] Filed: Aug. 29, 1980

[51] Int. Cl.[3] ..... E05D 15/06

[52] U.S. Cl. ..... 49/404; 49/449; 292/298

[58] Field of Search ..... 49/404, 449; 292/343, 292/288, 290, 297, 298

[56] References Cited

U.S. PATENT DOCUMENTS

| | | | |
|---|---|---|---|
| 2,461,398 | 2/1949 | Sands | 292/297 |
| 3,411,817 | 11/1968 | Carver | 292/298 |
| 3,714,738 | 2/1973 | Koslow | 49/404 |
| 3,731,341 | 5/1973 | Woodruff | 292/297 |

*Primary Examiner*—Kenneth Downey

*Attorney, Agent, or Firm*—Wheeler, House, Fuller & Hohenfeldt

[57] ABSTRACT

A door spacer adapted for mounting in the space between a sliding door and its top track to prevent vertical motion of the sliding door into the space adjacent its top track member, comprising a base member and first and second legs forming a triangle with an apex which extends vertically into the space between the sliding door and the top track. Means are provided to move the point of attachment of one leg to the base longitudinally along the base to adjust the vertical height of the apex above the base of the door spacer.

7 Claims, 6 Drawing Figures

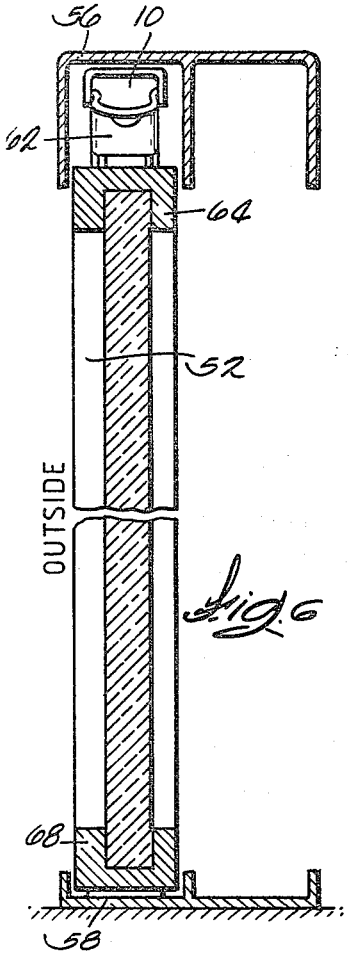
Fig. 6
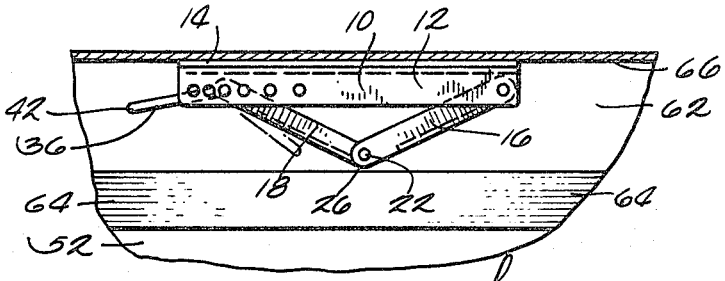
Fig. 5
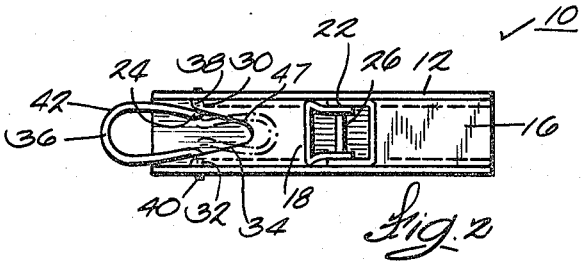
Fig. 2
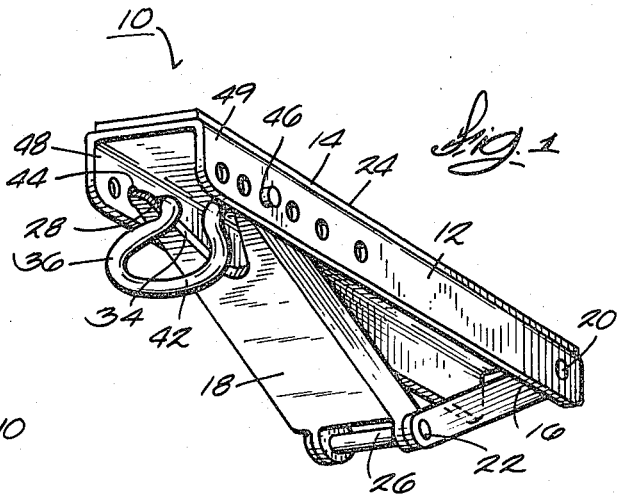
Fig. 1
Fig. 4
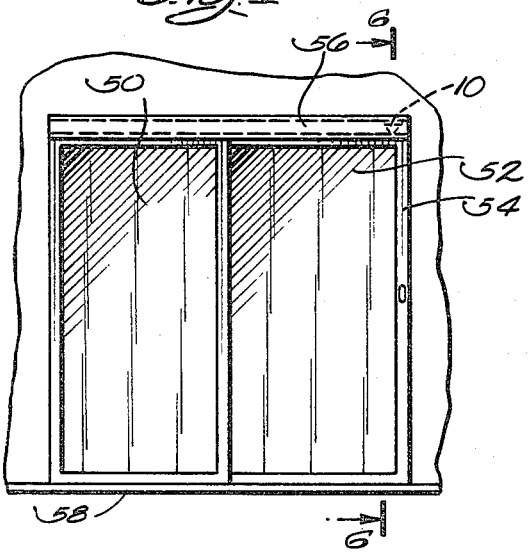
Fig. 3
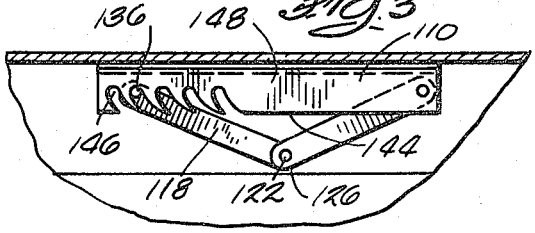

SLIDING DOOR SPACER

TECHNICAL FIELD

The present invention relates to a door spacer adapted to prevent vertical movement of a sliding door into the space adjacent the top track member of the door assembly. The primary use of such a door spacer is to prevent a sliding door or window from being raised into its top track member and then being lifted out of its lower track member and removed in order to obtain unauthorized access through the sliding door.

BACKGROUND ART

The prior art teaches door spacers having the general utility disclosed herein, but none of the door spacers of the prior art exhibit the improvements of the present invention.

U.S. Pat. No. 3,714,738 issued to Koslow et al. on Feb. 6, 1973 teaches sliding glass door retainer means to fill the space between the sliding glass door and the inside of the upper track retaining the door so that the sliding glass door can not be lifted vertically from the outside and thus removed by unauthorized persons. The door spacer of Koslow, best seen in FIG. 2 thereof, comprises oppositely tapered wedges 4 and 5, one of which is either mounted to the sliding door or the top track thereof, and the other of which rides up on the first wedge to adjust its vertical height above the door. When the wedges have been suitably adjusted, they are fastened together to preserve their relative alignment. The overall result of Koslow is to form an essentially rectilinear solid block which is fixed either to the door or the top track guiding the door and disposed in the space between the top track and the door in order to prevent the door from being lifted vertically into the top track.

U.S. Pat. No. 4,054,398, issued to Prohaska on Oct. 18, 1977 teaches the use of a spacer block such as 12, or a portion of another structure such as 8, fixed to the interior of the top track of the sliding door in order to prevent the sliding door from being raised as described above. Prohaska teaches adjustment of the vertical thickness of the spacer block by providing a block with a rectangular transverse cross-section so that the spacer block can be oriented with either a longer side or a shorter side vertical. Prohaska also teaches that plates may be added to the spacer block to change its effective height. Finally, Prohaska recognizes that double faced adhesive tape can be used to fix the latch assembly 8 within the top track of the sliding door. The primary utility of the device of Prohaska is to lock the sliding door with respect to horizontal sliding motion thereof.

U.S. Pat. No. 4,084,290, issued to Lymar et al. on Apr. 18, 1978 teaches a sliding door and window stop generally comprising stacked, horizontally disposed plates with adhesive applied between them. The vertical height of the device of Lymar is adjusted by peeling away a suitable number of the sandwiched layers to leave a residual structure with the appropriate thickness to limit the upward movement of the sliding door or window while allowing free sliding thereof.

The art thus illustrates that it is well known to provide a blocking member between the top of a sliding door and an inside portion of its top track in order to prevent the door from being lifted out of its bottom track into its top track, and then removed. The purpose of such device is to foil burglary or other unauthorized removal of sliding door or windows. The prior art devices can all be classified as solid blocks of material interposed between the top of the sliding door and the interior of its top track.

BRIEF DESCRIPTION OF THE INVENTION

The present invention has the same objects as those of the prior art, but the same end is accomplished by much different means.

The present invention is a door spacer comprising a rigid elongate base member; mounting means to mount the base member within the space between a sliding door and the interior of its top track; and first and second rigid legs attached to the base member and to each other to form a triangular brace with a generally horizontal base and an apex extending vertically away from the base into the space between a sliding door and the top track thereof.

Since the door spacer of the present invention is formed as an open-centered triangle, the strongest possible brace is provided for a given volume of brace material.

In a preferred embodiment of the present invention, the apex of the triangular brace is adjustable toward or away from its base in order to change the effective height of the brace within the space between the door and the top track which guides it. The brace can thus be adjusted to accomodate a particular door and top track assembly.

BRIEF DESCRIPTION OF DRAWINGS

FIG. 1 is a perspective view of a door spacer of the present invention.

FIG. 2 is a plan view of an inverted door spacer of the type shown in FIG. 1.

FIG. 3 is a side elevation of an alternate embodiment of the door spacer of the present invention, shown in place between a fragmentary door and its adjacent top track member.

FIG. 4 is a side elevation of a sliding door assembly, cut away to show the position of a door spacer of the present invention.

FIG. 5 is an enlarged side elevation of the door spacer and surrounding environment of FIG. 4.

FIG. 6 is a transverse cross-sectional view of FIG. 4 taken along line 6—6 thereof, showing an end elevation of the door spacer in place.

DETAILED DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

Referring first to FIG. 1, a door spacer 10 is shown comprising a rigid base member 12, mounting means 14, and first and second rigid legs 16 and 18, respectively attached together at first, second, and third means of attachment 20, 22, and 24. Base member 12 and first and second legs 16 and 18 form a triangle, which is recognized as a very strong structural element as to forces applied against apex 26 thereof.

In this embodiment of the invention, mounting means 14 is a strip of adhesive having two parallel major faces, one secured to the base member and the other adapted to be secured to the top of the sliding door or to the inside of the top track of the sliding door in order to prevent vertical movement of the door into its top track.

In a highly preferred embodiment of the present invention, adjustment means are provided to allow apex 26 to be moved toward or away from base member 12 to accomodate a particular door and track assembly. After this motion is completed base member 12, first leg 16 and second leg 18 are fixed rigidly together to form a structural triangle. To allow for such adjustment, first and second means of attachment 20 and 22 are pivotal linkages which allow first leg 16 to be pivoted about a transverse axis with respect to base member 12, and which allow second leg 18 to be rotated about a transverse axis with respect to first leg 16, but for the resistance to pivoting movement provided by third means of attachment 24.

Third means of attachment 24 is conveniently divided into locking means fixed to end 28 of a second leg 18, and lock receiving means formed as a part of base member 12.

The locking means comprises transversely registered holes 30 and 32 (See FIG. 2) defining the first and second ends of a transverse bore through end 28 of second leg 18. In this embodiment of the invention, the cut away portion 34 between holes 30 and 32 makes the central portion of the bore indefinite, but only the ends of the bore must be present in this embodiment of the invention. (As will be seen later, the cut away portion 34 of second leg 18 facilitates the adjustment of the vertical position of apex 26 to accomodate a particular door and track assembly). The locking means of third means of attachment 24 further comprises a locking clip 36. As best seen in FIG. 2, locking clip 36 comprises first and second ends 38 and 40 and a central loop portion 42.

The lock receiving portion of third means of attachment 24 comprises a series of longitudinally spaced pairs of transversely registered recesses such as 44 and 46 formed in first and second flanges 48 and 49 attached to base member 12. Each pair of recesses is adapted to receive and engage ends 38 and 40 of locking clip 36 when the pair of holes 30 and 32 defining a transverse bore in end 28 of second leg 18 are brought into registration.

FIG. 1 illustrates that loop portion 42 is accessible when the door spacer is assembled and fixed within the track of a sliding door (so long as the sliding door is temporarily slid out from under the door spacer), so that loop portion 42 may be compressed to force ends 38 and 40 axially inward out of a transversely registered pair of holes such as 44 and 46, thus freeing end 38 of second leg 18 with respect to base member 12 to allow ends 38 and 40 of locking clip 36 to be moved longitudinally to engage another transversely registered pair of holes located longitudinally of holes 44 and 46. This selection of a different pair of transversely registered holes changes the effective length of the base of the triangle and thus moves apex 26 of the triangle vertically toward or away from base member 12, changing the height of the triangle. This allows the door spacer of the present invention to be adjusted to nearly completely fill the space between the top of a particular sliding door and the inside top of the top track which receives the door.

In this embodiment of the invention, cut away portion 34 in end 28 of second leg 18 is bounded by a "V" shaped edge 47 (best seen in FIG. 2). Edge 47 cooperates with loop portion 42 in a preferred embodiment of the invention to allow ends 38 and 40 to more easily be moved axially inward to adjust the position of second leg 18 relative to base member 12. Ends 38 and 40 are moved axially inward by rotating loop portion 42 about a pivot formed by the engagement of ends 38 and 40 with holes 30, 32, 44 and 46, so that transversely spaced parts of loop portion 42 are received between inwardly tapered opposing portions of edge 47. (Such rotation is shown in FIG. 5.) The further loop portion 42 is pivoted into cut away portion 34, the narrower is the throat of portion 34, which engages it. Thus, insertion of loop portion 42 between transversely opposed parts of edge 47 causes edge 47 to bear inwardly on loop portion 42, forcing ends 38 and 40 of locking clip 36 axially inward. One feature of this construction is that favorable leverage can be exerted to retract ends 38 and 40 out of holes such as 44 and 46. Another feature of this construction is that loop portion 36 will not pivot into a position which will interfere with motion of a sliding door underneath it, for it cannot rotate substantially about the pivot described without manual aid.

FIG. 3 shows an alternate embodiment of third means of attachment 24. In this embodiment, wherein corresponding parts are indicated by reference characters differing by 100 units, transversely registered pairs of open-sided recesses such as 146 are formed in the respective flanges 148 and 149. Recesses 146 extend from an interior portion of each flange such as 148 through the vertical extremity thereof. In the embodiment of FIG. 3, locking clip 136 may be a rigid pin extending transversely from second arm 118, since in this embodiment of the invention the ends of the locking clip are received in recesses such as 130 extending through the vertical extremity of flange 148. In this embodiment, apex 126 rides on the top of the sliding door, and thus locking clip 136 cannot escape from recess 146 unless the door is slid completely out from under spacer 110. In that event, the lock may be reengaged and held manually in place until the sliding door is again moved into a position under spacer 110. Because recess 146 is an arcuate slot having a center of curvature spaced from second means of attachment 122, second arm 118 cannot pivot freely out of recess 146 while the door is in place.

The balance of the structure of FIG. 3 is virtually identical to the structure of FIG. 1 and therefore need not be described in further detail.

FIGS. 4,5 and 6 show a door spacer of the present invention positioned between the top of a sliding door and the interior of the top track which supports the door. In FIG. 4, a sliding door assembly is shown having at least one door such as 50 or 52 having a rigid frame 54 around its perimeter. At least one of doors 50 and 52 is slidably carried in a top track 56 and a bottom track 58. In the present embodiment of the invention as shown in FIG. 4, door 50 is fixed and sliding door 52 is slidable from a closed position (as shown) to an open position in which sliding door 52 is located transversely of fixed door 50. When sliding door 52 is closed, it may be locked by means (not shown) which are usually adjacent frame member 60 of sliding door 52. It is highly desirable to mount the door spacer vertically above the locked portion of the door to particularly prevent vertical movement adjacent the locking means, so door spacer 10 is located above the portion of sliding door 52 which carries the locking means for sliding door 52.

FIG. 5 shows the door spacer 10 and the surrounding parts of the sliding door assembly of FIG. 4 in greater detail.

Door spacer 10 is mounted in the space 62 which is formed between top frame member 64 of door 52 and a top frame member 66 of top track 56. Although the door spacer 10 is shown with its base member 12 mounted to the interior of top frame member 66 by an adhesive layer comprising mounting means 14, it will be apparent that the door spacer 10 could equally be inverted and mounted to top frame member 64 of sliding door 52 without departing from the present invention. (Of course, such an embodiment would require that the brace first be adjusted for height, and then be inserted via space 62 and secured in place.) Also, other mounting means 14, such as self tapping screws passing through base member 12 and into top frame member 66, can equally be used.

With locking clip 36 in place, door spacer 10 is a rigid triangle having an apex 26 which interferes with vertical motion of top frame member 64 of sliding door 52 with respect to top frame member 66 of top track 56. (Slight clearance between apex 26 and top frame member 64 is provided to allow door 52 to slide within top track 56.)

FIG. 6 shows an enlarged cross-sectional view of the top and bottom extremities of the sliding door assembly with an end elevation of a door spacer in place. FIG. 6 shows why it is important to provide a door spacer 10 for the sliding door assembly. Without door spacer 10 in place, sliding door 52 can easily be opened by lifting it upward into space 62 within top track 56 sufficiently to raise the bottom frame member 68 of the sliding door 52 out of bottom track 58. The bottom frame member 68 of sliding door 52 can then be displaced transversely to free the bottom of the door. The sliding door 52 can then be lowered to free it from top track 56. A thief can easily open the door in this way absent door spacer 10. But with door spacer 10 in place, it is evident that sliding door 52 cannot be lifted into space 62 and then out of bottom track 58 in order to remove the door from the tracks that carry it.

Moreover, the door cannot easily be removed by tilting it within the tracks or by deforming part of one track with a pry bar or the like so long as the door spacer 10 is mounted in its preferred position, which is generally above the door lock.

It will be evident that the triangular construction of the door spacers of the present invention makes them superior to prior door spacers, which are essentially solid blocks. An open triangular frame member has long known to be the strongest possible frame member which can be built with a given amount of material, since a triangle cannot be compressed without bending one of its legs. Since the legs of the preferred embodiment of the invention are three-sided channel members it is very difficult to bend any of the legs. The present door spacers are thus extremely difficult to compress vertically. Accordingly, the door spacers of the present invention are a material advance over earlier door spacers which do not utilize the principle of triangular construction.

I claim:

1. A door spacer to prevent vertical movement of a sliding door into the space adjacent its top track member comprising:

a. a rigid, elongate base member;

b. mounting means to mount said base member generally horizontally within said space; and c. first and second rigid legs attached to said base member by first and third means of attachment and to each other by second means of attachment to form a triangle with a generally horizontal base and an apex, adjacent said second means of attachment, extending vertically into said space, d. wherein said first and second means of attachment are respectively first and second pivotal linkages allowing rotation around first and second transverse axes, e. and wherein said third means of attachment comprises locking means which is fixed to one end of said second leg and lock receiving means on said base member to receive said locking means at a selected one of at least two longitudinally separated points, whereby to allow adjustment of the vertical distance between said apex and said base member by adjusting said locking means of said third means of attachment longitudinally relative to said base member.

2. The door spacer of claim 1, wherein said lock receiving means comprises:

a. first and second parallel side flanges on said base member having transversely opposed major faces extending vertically into said space and longitudinally along said base member; and b. plural longitudinally spaced transversely registered pairs of recesses extending transversely into said flanges through said opposed major faces.

3. The door spacer of claim 2, wherein said locking means comprises:

a. a transverse bore in the end of said second leg adjacent said base which is movable into registration with a selected pair of said recesses;

and b. retracting clip means having first and second ends usually urged outward from the ends of said transverse bore into engagement with a selected pair of said recesses when said transverse bore and pair of recesses are in registration, wherein said first and second ends are axially retractable out of engagement with said pair of recesses to release said locking means from said base member.

4. The door spacer of claim 3, wherein said retracting clip means further comprises an axially resilient loop portion extending between its first and second ends and tending to urge said first and second ends axially apart.

5. The door spacer of claim 4, wherein said loop portion is accessible to an exterior portion of the door spacer, whereby said loop portion can be transversely compressed, thereby axially retracting said first and second ends of said retracting pin means.

6. The door spacer of claim 2, wherein said recesses each comprise a slot formed in one of said flanges extending from an internal portion of said flange through the vertical extremity thereof, and wherein said locking means comprises a pin fixed to said second leg and extending transversely thereof to engage a pair of said recesses and thereby lock said second leg to said base member with respect to motion of said apex toward said base member.

7. The door spacer of claim 6, wherein each said recess is an arcuate slot having a center of curvature spaced from said apex.

* * * * *